United States Patent [19]

Bernard

[11] 3,960,294

[45] June 1, 1976

[54] VISCOUS MATERIAL DISPENSER

[76] Inventor: Rodolphe J. Bernard, 16330 Sandalwood, Fountain Valley, Calif. 92708

[22] Filed: June 18, 1975

[21] Appl. No.: 587,909

[52] U.S. Cl. ..... 222/103; 222/175

[51] Int. Cl.[2] ..... B65D 35/28; B65D 5/64

[58] Field of Search ..... 222/103, 175

[56] References Cited

UNITED STATES PATENTS

| | | | |
|---|---|---|---|
| 103,640 | 5/1870 | Merritt | 222/103 X |
| 2,073,473 | 3/1937 | Gay | 222/103 |
| 2,549,233 | 4/1951 | Phillips | 222/175 X |
| 2,915,222 | 1/1959 | Purinton | 222/175 |

FOREIGN PATENTS OR APPLICATIONS

| | | | |
|---|---|---|---|
| 285,745 | 2/1928 | United Kingdom | 222/103 |

*Primary Examiner*—Allen N. Knowles
*Assistant Examiner*—Hadd Lane

[57] ABSTRACT

A dispenser for applying non-solid, thixotropic, viscous materials — as, for example, mastic, caulking compound, coatings, paints or heavy greases — the dispenser being adapted to removably receive disposable, interchangeable, collapsible bag means which contains the material to be dispensed, and including a trigger-operated handle adapted to receive a flexible discharge tube therethrough. Various discharge tips or rollers can be interchangeably attached to the discharge tube. The dispenser also includes a manually operated, compressive means to dispense the needed material in required amounts.

8 Claims, 16 Drawing Figures

VISCOUS MATERIAL DISPENSER

BACKGROUND

1. Field of the Invention

This invention relates generally to dispensing devices and, more particularly, to a dispensing device for thixotropic material that is provided with a plurality of discharging tips.

2. Description of the Prior Art

In the construction trade, large quantities of mastic coating, paints and caulking compounds are continuously being used. As would be expected, very large quanities are consumed in one operation. The uses involve sealing between joints or coating various surfaces to provide a protective or decorative film, and also the applying of adhesives.

In applying various sealing compounds, the workman, in doing so, encounters problems such as corner surfaces and sloped — or even curved surfaces — which need to be coated. There is no simple device to aid in coating under such conditions.

Oftentimes, the joints between the surfaces to be protected may vary from one eighth of an inch, or less, to nearly an inch. Thus, it becomes a problem controlling the volume of non-solid materials with respect to each varying work situation. Not only is volume control of the dispensing material required, but very often the shape and dimension of the stream of material, as it is being dispensed from the dispenser, are critical.

Industry, in general, relies upon high viscosity oils, greases for lubrication, and other thixotropic materials that are required to be dispensed in large volumes. As an example of one industry, the printing trade uses paste inks which must be dispensed in varying amounts and shapes under controlled conditions.

Various approaches have been tried to solve these and other associated problems, such as disclosed in the U.S. Pat. to Martin No. 3,070,825 which teaches the use of an applicator for paint rollers having a means for feeding the paint to the roller during use.

Another arrangement of a paint applicator is shown and described in U.S. Pat. No. 3,612,707 to Charles Herbrechter, et al. This invention provides paint to the interior of the roller rather than on the surface thereof, as is the case in the Martin device.

The Ames U.S. Pat. No. 2,711,098 illustrates a mastic-applying, finishing tool with very limited applications thereof.

U.S. Pat. No. 1,965,596 to Kline sought to solve the problem for the printing industry by exerting pressure against the tube of ink, using a squeeze device.

SUMMARY

The present invention provides a dispenser for applying various non-solid, thixotropic materials such as caulking compounds and mastics. The device, in general, comprises a housing defined by a pair of hinged walls in which a disposable, compressible bag is received therein, the bag having the dispensable material stored therein.

Operably attached to one wall is a spring-biased, variable compression means including a take-up mechanism having a cable attached thereto. The free end of the cable is provided with a hood designed to be removably connected to the opposite hinged wall, whereby the bag disposed in the housing is placed under constant pressure.

A discharge tube is attached to a discharge nipple secured to the bag through which the material flows when being dispensed therefrom. Adjacent the free end of the tube is a trigger-operated valve means arranged within a handle. The operation of the valve means permits the control of the amount of material to be discharged. In addition, the free end of the tube includes a coupling means whereby various dispensing applicators can be attached thereto. The type of applicator will depend on the particular need and application thereof.

OBJECTS AND ADVANTAGES OF THE INVENTION

Thus, it is an important object of the present invention to facilitate the use of mastic, caulking compounds or coatings in industry by enabling a worker to carry a comparatively large volume of material in a device attached to his person, and dispense it through a flexible tube in a continuous stream in difficult work situations without the use of air pressure or other power means.

It is another object of this invention to provide an improved means to dispense non-solid materials, wherein the device only requires the use of only one hand during the operation thereof.

It is still another object of the invention to provide a viscous material dispenser that allows the discharge of the material therefrom to vary in volume and shape by means of a series of uniquely designed, interchangeable, discharge tips and rollers.

It is a further object of the present invention to provide a viscous material dispenser that can be used in the air conditioning, plumbing and lubricating industry by merely interchanging the contents of the bag and the tip configuration.

A still further object of the invention is to provide a device of this character whereby printers can use the device to dispense ink by mounting the device above the ink rollers and attaching an automatic pressure-adjustment means thereto.

It is still another object of this invention to provide a device of this character that is simple and rugged in construction, and capable of a relatively long working life.

It is a further object of the present invention to provide a device of this character that is easy to service and maintain.

It is still another object of this invention to provide a device of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or mode of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
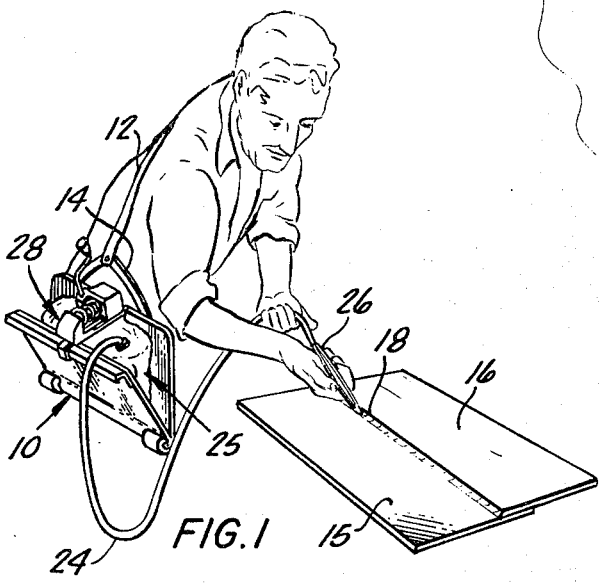
FIG. 1 is a pictorial view of the present invention, illustrating one of the various uses found in the construction industry, wherein two segments are being sealed together.
Figure 2:
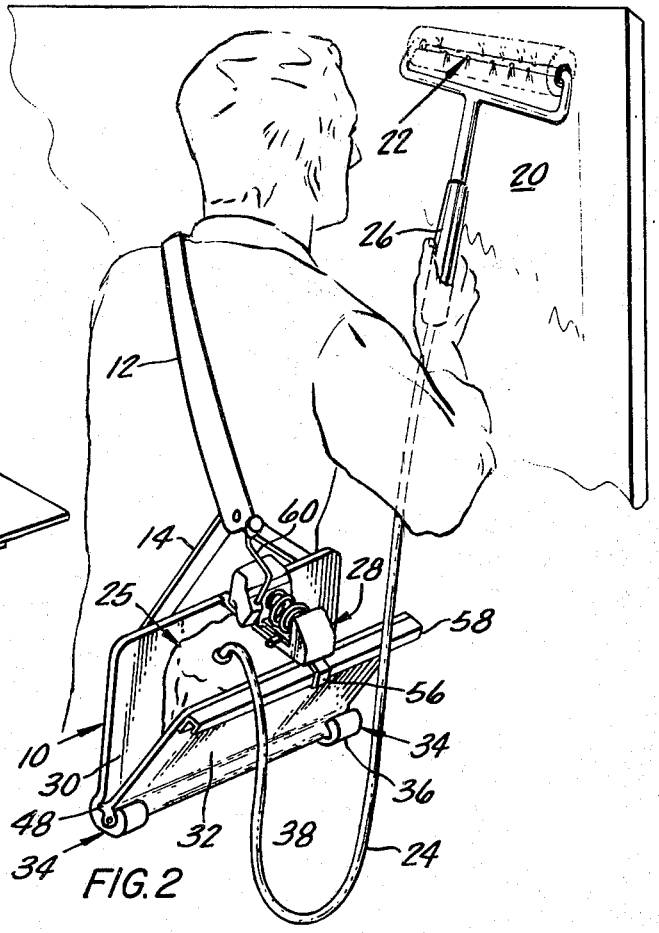
FIG. 2 is another pictorial view thereof wherein the device is associated with a paint applicator, whereby paint is supplied to the roller in an even, continuous manner.

Referring to the drawings, and more particularly to FIGS. 1 and 2, the present invention is illustrated in two of the many uses to which the device might be applied.

FIG. 1 illustrates a workman having the viscous material dispenser, generally indicated at 10, supported by a shoulder strap 12. The strap 12 is disposed about the individual whereby said material dispenser 10 hangs to one side of the operator, the strap being removably connected to a second support strap 14 which is also illustrated in the same manner in FIG. 2. However, FIG. 1 shows the operator applying material to two overlapping workpieces 15 and 16, respectively. The material 18 could be any number of caulking compounds or mastic substances, these materials being of a thixotropic consistency.

FIG. 2 illustrates the dispenser 10 being used in connection with applying paint, indicated at 20, in a continuous manner by a roller 22 operably connected to said dispenser 10. The details of the above will hereinafter be described.

In each of the above applications, a discharge tube 24 is interconnected between the applicator tip or device and the material-container means, generally indicated at 25, and being shown as a flexible, plastic, collapsible bag which is constantly under pressure. The flow of the material is controlled by a gun-type handle 26 having a valve means disposed therein for direct contact with the discharge tube 24.

The continuous pressure on the bag is created by manually operated, compression means, generally designated at 28.

Accordingly, the viscous material dispensor 10 comprises a jaw-like housing defined by a pair of hinged walls 30 and 32. These walls are pivoted about hinge means 34, which are disposed on opposite, lower corners of each wall, as seen in FIG. 2. There is a female member 36 of the hinge means which is integrally formed as part of wall 30, and a male member 38 integrally formed in wall 32 and extending longitudinally along the lower edge thereof, whereby said wall 32 is rotatably supported by wall 30.

Figure 3:
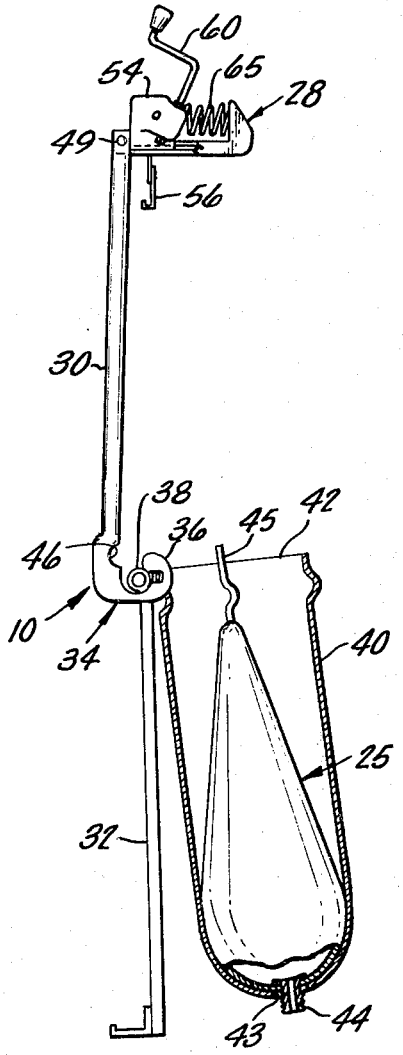
FIG. 3 is a side-elevational view with the device in an open position to receive a bag of material therein, with portions thereof broken away.

Referring to FIG. 3, the housing of device 10 is shown in a fully open mode, wherein the wall 32 is illustrated as depending downwardly. Attached to wall 32 is a receptacle 40 formed of a flexible, plastic material adapted to have an upper opened end 42 in which bag 25 is received. The lower bottom portion of the receptacle is provided with a hole 43 large enough to receive a threaded nipple 44 which in an integral part of the material-containing bag 25.

Figure 4:
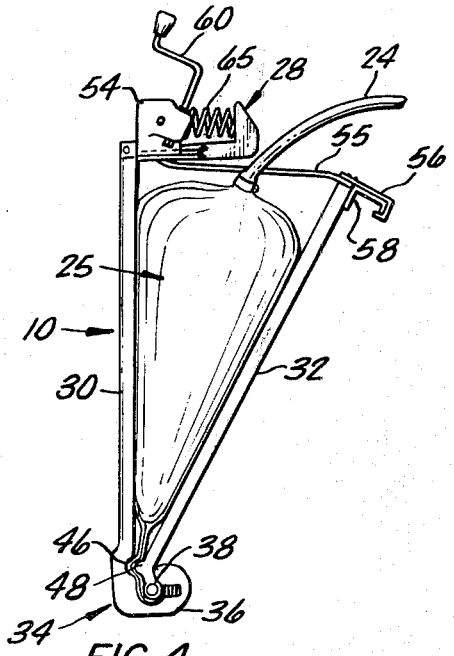
FIG. 4 is another side-elevational view of the present invention wherein the device is shown in a closed position, with the material being ready for discharge from the bag through the discharge tube.

Hence, when an operator is ready, he opens the walls as shown and inserts the bag 25 into receptacle 40, with the nipple 44 extending through hole 43 — at which time said wall is rotated to a position shown in FIG. 4. Just prior to completing this mode, a longitudinal lip 45, is formed along the end of the bag 25 opposite that of the nipple 44; and the free ends of the receptacle 40 are positioned to be clamped within a retainer means formed as part of each wall.

The retainer means comprises a longitudinal channel or groove 46, arranged in wall 30, and a matching longitudinal rib 48 formed in wal 32. Once the walls 30 and 32 are latched into position, rib 48 locks the receptacle 40 and bag 25 into the housing, whereby the bag and material therein are restrained from being pulled therefrom.

The manually operated compression means 28 is attached to the upper edge of wall 30 at a central point thereon by a pin 49 which allows said compression means to pivot, if necessary. A take-up mechanism is included as part of the compression means and is removably linked to the upper edge of wall 32.

Figure 5:
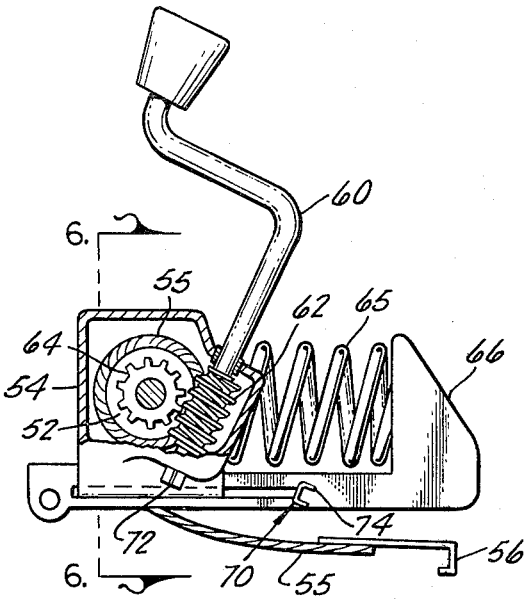
FIG. 5 is an enlarged, side-elevational view of the variable compression means with a portion thereof broken away, showing the gear assembly therein.
Figure 6:
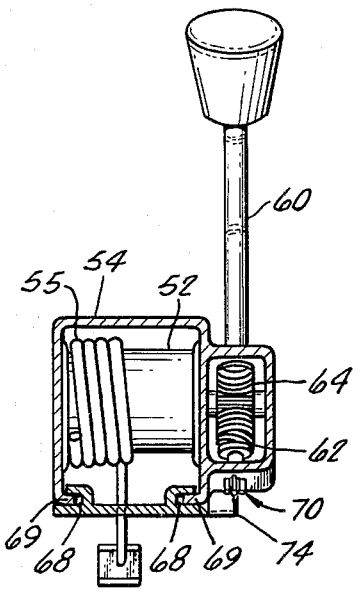
FIG. 6 is a cross-sectional view taken substantially along line 6 — 6 of FIG. 5.
Figure 8:
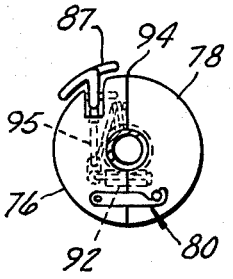
FIG. 8 is an end view of that shown in FIG. 7.

The following is a description of both the compression means and the take-up mechanism, as better seen in FIGS. 5 and 6. Said take-up mechanism comprises a spool 52 rotatably supported in a slidable frame member 54, the spool being adapted to receive a length of cable 55 of which one end thereof is affixed to said spool and the free end is provided with a hook 56. Hook 56 is formed to couple with a latch bar 58 secured along the longitudinal, upper edge of wall 32. When the hook 56 is so coupled as in FIG. 4, the crank 60 is rotated to tighten the cable 55 — forcing wall 32 inwardly and compressing bag 25 and the material therein.

In order to do this, crank 60 is provided with a worm gear 62 that meshes with gear 64 affixed to spool 52. Thus, as crank 60 is rotated, cable 55 is wound around spool 52, pulling hook 56 and wall 32 inwardly — at which time the biasing spring 65 is forced to compress between the frame 54 and the carriage 66, the frame being slidable on carriage 66, as seen in FIG. 6.

Carriage 66 includes a pair of oppositely disposed channels 68 adapted to receive flanges 69 therein, the flanges being an integral part of frame 54. The frame 54 is allowed to slide forward until a stop means 70 engages. This stop means can be any suitable device but is herein shown as a rachet 72 connected to crank 60, the ratchet being so arranged as to catch in a keeper 74 — wherein the crank can not be rotated further and the frame is held from forward movement on the carriage. Thus, the spring is limited to a predetermined compression. As the crank is released, the frame 54 — along with the cable 55 and hook 56 — is biased rearwardly wherein a compression force is imparted through wall 32, thereby squeezing the material in bag 25.

The material, however, can only flow up to the gun handle 26. The gun handle comprises a main-body portion 76, and a removable cover 78 which is secured to the main body 76 by dowel pins 79, adapted to be received in body 76, and a latching means, indicated at 80.

Figure 7:
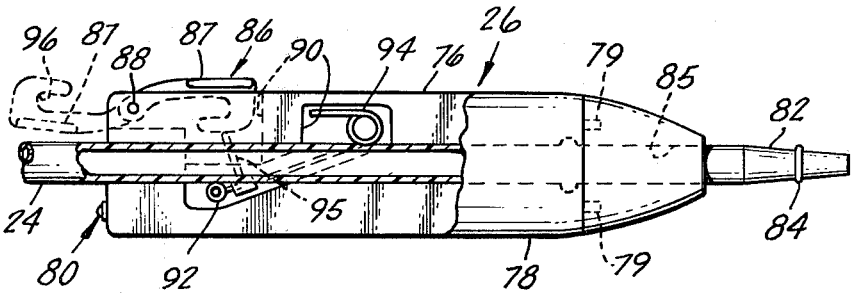
FIG. 7 is an enlarged view of the trigger-handle dispenser, with a portion thereof broken away to better show the valve means disposed therein.
Figure 13:
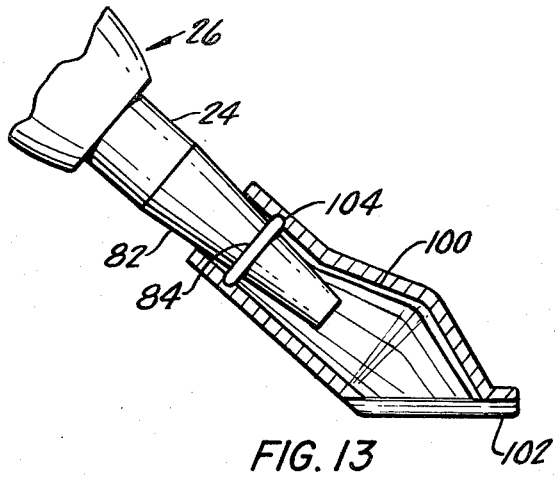
FIG. 13 is a cross-sectional view of FIG. 9 as the tip would be secured to the discharge end of the tube.

The tube is removably positioned within handle 26 and held in place by cover 78, as seen in FIG. 7. The free end of tube 24 is designed with a taper having a reduced diameter as at 82. An annular coupling ring 84 is formed about the reduced portion, said ring having a diameter equal to, or less than, the outer tube diameter, whereby the tube can readily pass through boss 85.

Operably disposed within the main body 76 of the handle is a trigger-operated valve means, generally indicated at 86. Said valve means comprises a trigger 87 hinged to the handle by pin 88 and adapted to be received within cavity 90.

Cavity 90 is so formed as to receive a biased-valve arm 92. This arm is arranged to engage tube 25 under a biasing forced caused by the integrally formed, spring, free end 94. Due to the biasing force of spring 94, the arm closes the tube passage, thereby stopping all discharge flow from bag 25. Thus, the pressure on the material in bag 25 cannot be utilized until trigger 87 engages valve leg 95 in order to force valve arm 92 downwardly; thereupon, the tube passage is opened for flow therethrough.

It should be mentioned at this point that trigger 87 also includes a means by which the gun handle 26 can be hung when not in operation. This means comprises a hook 96.

As heretofore mentioned, various applicators can be interchangeable with the above-disclosed device. Thus, several tips are shown in FIGS. 9 through 15; and in FIG. 16 there is an additional application of the invention.

Figure 9:
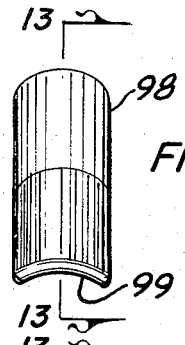
FIGS. 9 through 11 are views illustrating various dispensing tips that are adapted to be connected to the discharge tube.
Figure 10:
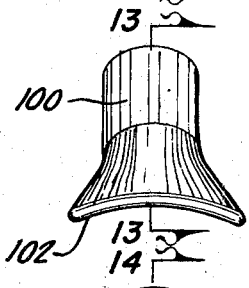

FIG. 9 shows a tip applicator 98 having a shallow arc 99 by which a small bead of material is formed. FIG. 10 illustrates a tip 100 with an enlarged arc 102 wherein the bead formed thereby will have an enlarged width.

Figure 11:
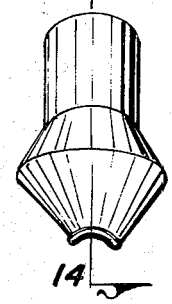
Figure 14:
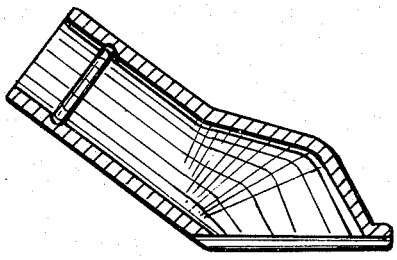
FIG. 14 is a cross-sectional view taken substantially along line 14 — 14 of FIG. 11.

FIG. 11 is still a further design of a tip similar to the above tips. However, each of the applicator tips includes an annular groove 104 to receive the coupling rib 84 on tube 26. This is clearly illustrated in FIG. 13.

Figure 15:
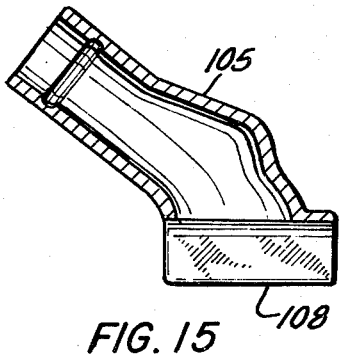
FIG. 15 is a cross-sectional view taken substantially along line 15 — 15 of FIG. 12, wherein the workpieces have been omitted therefrom.
Figure 12:
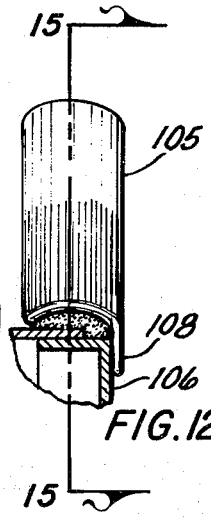
FIG. 12 is a dispensing tip for use with end overlapping workpieces.
Figure 16:
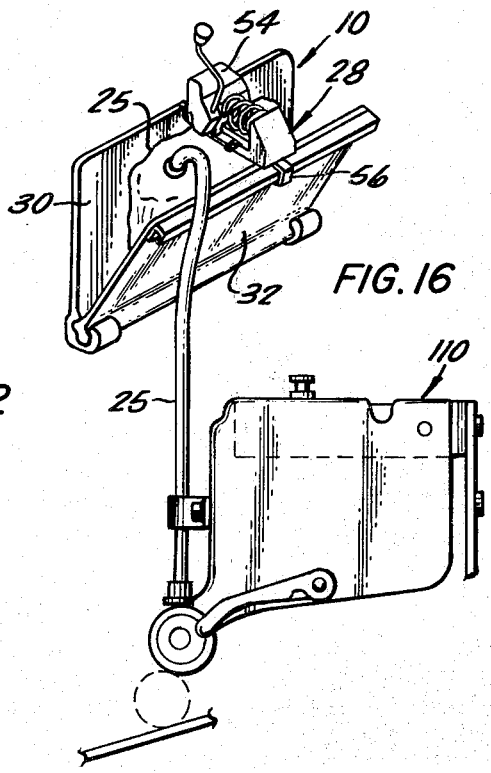
FIG. 16 is a pictorial view illustrating the present invention attached to a portion of a printing-ink applicator.

In FIGS. 12 and 15 there is shown an applicator tip 105 designed for applying a bead of material to an outside corner of a workpiece 106, wherein the tip 105 includes a depending guide wall 108.

As an illustration of how this disclosed invention can be adapted to several fields of operation, the device is shown connected to an ink feeder, indicated generally at 110, for printing presses, not shown. The bag 25 would then be filled with an inking paste or the like.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A dispensing device for viscous materials comprising:

a housing having a pair of hinged walls;

a container means wherein the viscous material is stored therein, said container being removably disposed in said housing;

hinge means positioned along the lower portion of said walls for pressure engagement with said container means;

a discharge tube operably connected at one end thereof to said container means, whereby said viscous material can flow therefrom;

a compression means attached to each of said walls, imparting an inward compression force thereto;

wherein said compression means includes a take-up mechanism, said compression means being hingedly attached to one wall of said housing, and said take-up mechanism being operably accuated by the compression means and removably attached to said opposite wall whereby the viscous material is continuously and automatically placed under discharge pressure;

a control-valve means mounted to said discharge tube, whereby the flow of material is controlled from said container; and coupling means formed in the free end of said discharge tube.

2. A dispensing device as recited in claim 1, wherein said compression means also includes:

a slidable frame;

a carriage formed to slidably receive said frame thereon;

a spool rotatably supported in said frame;

a cable wound around said spool having a hook means secured to the free end thereof for removable attachment to one of said walls;

a crank means for rotating said spool; and a biasing means positioned between said frame and said carriage.

3. A dispensing device as recited in claim 2, wherein said housing includes as receptacle to support said container means therein, said receptacle having a hole disposed therein.

4. A dispensing device as recited in claim 3, wherein said container means comprises:

a flexible, plastic bag formed as a continuous sealed envelope having said viscous materials stored therein;

a nipple outlet mounted to said bag to receive said discharge tube thereon; and retainer means formed as part of said bag and said housing, whereby said bag is held therein.

5. A dispensing device as recited in claim 4, wherein said device includes:

a gun handle having a main body with a cavity disposed therein and a removable cover; and a trigger means operably supported in said main body and wherein said control valve means is disposed within said cavity and operated by said trigger means.

6. A dispensing device as recited in claim 5, wherein said retainer means comprises:

a longitudinal lip member formed along one end of said bag opposite that of said nipple outlet;

an elongated channel formed along the lower edge of one wall; and an elongated rib member formed in said other wall and arranged to be received in said channel of said opposite wall thereof, wherein said longitudinal lip of said bag is locked therebetween.

7. A dispensing device as recited in claim 5, wherein said gun handle includes a latching means whereby said cover can be removably latched to said main body of said handle.

8. A dispensing device as recited in claim 5, wherein said control valve comprises:

a valve arm positioned in said handle for direct engagement with said discharge tube;

a leg member attached to said arm for operable engagement with said trigger means; and a biasing means integrally formed as part of said valve arm.

* * * * *